US007628147B2

(12) United States Patent
Estalella

(10) Patent No.: US 7,628,147 B2
(45) Date of Patent: Dec. 8, 2009

(54) APPARATUS FOR UNDERHAND TOSSING OF A BALL

(76) Inventor: Robert M. Estalella, 13732 NW. 11th Ct., Pembroke Pines, FL (US) 33028

( * ) Notice: Subject to any disclaimer, the term of this patent is extended or adjusted under 35 U.S.C. 154(b) by 282 days.

(21) Appl. No.: 11/672,286

(22) Filed: Feb. 7, 2007

(65) Prior Publication Data

US 2008/0184979 A1 Aug. 7, 2008

(51) Int. Cl.
*A63B 69/40* (2006.01)
*F41B 3/00* (2006.01)

(52) U.S. Cl. ..... 124/7; 124/16

(58) Field of Classification Search ..... 124/4, 124/6, 7, 16, 36

See application file for complete search history.

(56) References Cited

U.S. PATENT DOCUMENTS 1,783,053 A * 11/1930 Baden-Powell ..... 124/6
2,815,743 A 12/1957 Brunderman
4,122,822 A 10/1978 Scheiwiller
4,262,648 A 4/1981 Wegener et al.
4,269,162 A * 5/1981 Abraham et al. ..... 124/7
4,391,264 A * 7/1983 Abraham et al. ..... 124/50
4,471,746 A * 9/1984 Ando ..... 124/6
4,611,571 A * 9/1986 Tressler et al. ..... 124/7
4,784,107 A * 11/1988 Kelly ..... 124/61
4,995,371 A * 2/1991 Kuizinas ..... 124/7
5,121,735 A 6/1992 Hancock
6,715,478 B1 4/2004 Tanner

* cited by examiner

*Primary Examiner*—John Ricci
(74) *Attorney, Agent, or Firm*—Larson & Larson, P.A.; Frank Liebenow

(57) ABSTRACT

An apparatus for underhand tossing of a ball includes a cabinet with a hollow tossing arm pivotally coupled thereto. A mechanism is provided to dispense a single ball at a time from a supply of balls into the hollow tossing arm. A spring is affixed at one end to the hollow tossing arm and affixed at a distal end to the cabinet at a point forward of the hollow tossing arm. A machine is provided for pulling a distal end of the hollow tossing arm toward a back end of the cabinet and releasing the hollow tossing arm such that the distal end of the hollow tossing arm swings forward, releasing the ball at a point at which the hollow tossing arm hits a stop peg.

14 Claims, 11 Drawing Sheets

APPARATUS FOR UNDERHAND TOSSING OF A BALL

BACKGROUND OF THE INVENTION

1. Field of the Invention

This invention relates to the field of automated ball practice and more particularly to a system for tossing balls to automate practice of sports such as baseball, softball, tennis and racquetball.

2. Description of the Related Art

In order to become a successful ball player, one must repetitively practice each skill required for the position in which one wishes to aspire. Many ball games include eye-hand coordination whereas an object held in the hand must meet with a ball traveling at varying speeds and trajectories. For example, a baseball player must have sufficient hand-eye coordination as to hit with a bat, a ball that is being pitched. Likewise, a tennis player must hit an incoming tennis ball with a racquet. To hone their skills, a player must practice such hitting/returning over and over.

In bat and ball sports (baseball, softball, etc), eye-hand coordination is also required for catching a ball. To provide a variety of balls to catch, often a batter will toss up a ball and hit it to a fielder, called Fungo hitting. This is often performed using a specially designed bat.

Several machines have been designed and some produced to automate some level of practice. Pitching machines generally emit a ball at a varying speed with a relatively small arc of travel for a hitter to practice baseball hitting or tennis returns. An example of such is described in U.S. Pat. No. 6,715,478 to Tanner, which is hereby incorporated by reference. Although the disclosed machine works well at pitching a ball directly towards the player, it does not provide a large arc or lob. A hitter that is performing Fungo hitting would not be able to provide ample fly-ball simulation to help fielders practice with such a machine. Furthermore, a tennis or racquetball player needs to practice their timing when a ball comes at them with a high arc. The machine of the cited patent does not provide for an arc. Additionally, due to the speed of such pitching and the reaction time of the player, such a pitching machine must be located at a considerable distance from the player.

Another such machine is described in U.S. Pat. No. 5,121,735 to Hancock. This machine, too, pitches directly at the player rather than tossing up the ball.

Another such machine is described in U.S. Pat. No. 4,611,571 to Tressler. Likewise, this machine pitches directly at the player rather than tossing up the ball.

U.S. Pat. No. 4,262,648 to Wegener, et al., discloses a softball pitching machine. This machine pitches directly at the player rather than tossing up the ball.

U.S. Pat. No. 4,122,822 to Scheiwiller discloses an apparatus for projecting footballs by striking the footballs. This machine pitches the footballs directly at the player rather than tossing the ball in an upward direction. Its striking feature may damage other types of balls such as softballs, baseballs, tennis balls, etc.

What is needed is an apparatus that will simulate an underhand toss of a ball or other round object for fungo hitting and practice returning balls with high arcs.

SUMMARY OF THE INVENTION

In one embodiment, an apparatus for underhand tossing of a ball is disclosed including a cabinet with a hollow tossing arm pivotally coupled to it. A mechanism is provided to dispense a single ball at a time from a supply of balls into the hollow tossing arm. A spring is affixed at one end to the hollow tossing arm and affixed at a distal end to the cabinet at a point forward of the hollow tossing arm. A machine is provided for pulling a distal end of the hollow tossing arm toward a back end of the cabinet and releasing the hollow tossing arm such that the distal end of the hollow tossing arm swings forward, releasing the ball at a point at which the hollow tossing arm hits a stop peg.

In another embodiment, a method of practicing ball is disclosed including providing a device for underhand tossing of a ball that includes a cabinet with a hollow tossing arm pivotally coupled to it. A device is provided for dispensing a single ball at a time from a supply of balls into the hollow tossing arm. A spring is affixed at one end to the hollow tossing arm and affixed at a distal end to the cabinet at a point forward of the hollow tossing arm and there is a mechanism for pulling a distal end of the hollow tossing arm toward a back end of the cabinet and for releasing the hollow tossing arm such that the distal end of the hollow tossing arm swings forward pulled by the spring, releasing the ball at a point at which the hollow tossing arm hits a stop peg. The method continues with setting the device for underhand tossing of a ball to automatically toss balls in the air, then allowing the ball to arc and hitting the ball with a hitting object on a downward travel of the ball.

In another embodiment, a tossing machine is disclosed including a cabinet with a hollow tossing arm pivotally coupled at to it. The hollow tossing arm has an opening near its first end large enough for a ball to pass into the hollow part of the hollow tossing arm; the opening is at least partially obstructed when a distal end of the hollow tossing arm is in a first range of travel. A spring is affixed at one end to the hollow tossing arm and at a distal end to the cabinet at a point forward of the hollow tossing arm. A motor with a gear pulls and releases the hollow tossing arm. The gear has gear teeth on only a portion of a circumference and missing teeth on the remainder of the circumference. A rack with rack gear teeth for mating with the gear teeth interfaces with the gear. The rack is coupled to the hollow tossing arm so that rotation of the gear pulls the rack and tossing arm toward a back end of the cabinet until the missing teeth interface with the rack thereby releasing the rack allowing the distal end of the hollow tossing arm to swing forward pulled by the spring and the ball is tossed when the hollow tossing arm hits a stop peg.

BRIEF DESCRIPTION OF THE DRAWINGS

The invention can be best understood by those having ordinary skill in the art by reference to the following detailed description when considered in conjunction with the accompanying drawings in which.

DETAILED DESCRIPTION OF THE INVENTION

Figure 1:
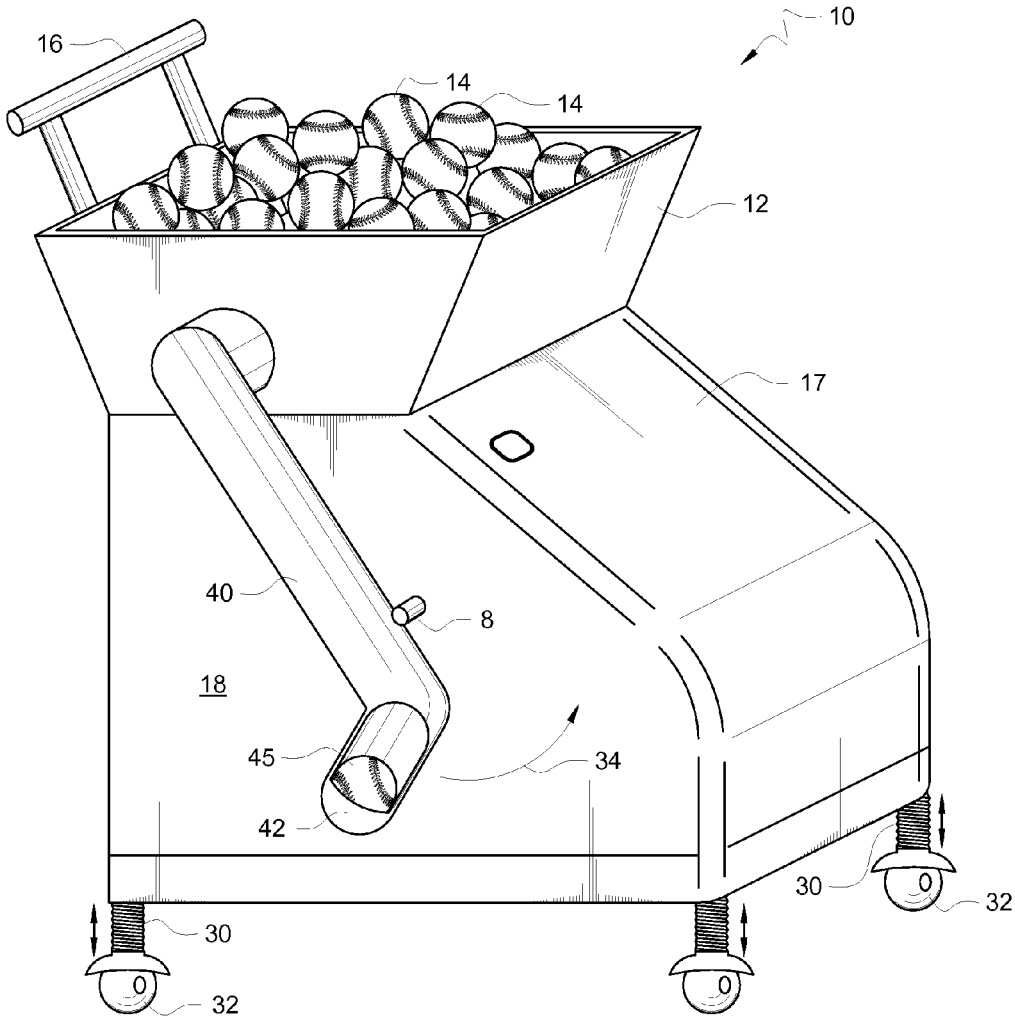
FIG. 1 illustrates a first side isometric view of an apparatus for underhand tossing of a ball of a first embodiment of the present invention.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a first side isometric view of an apparatus for underhand tossing of a ball of a first embodiment of the present invention is shown. The underhand ball tossing machine 10 tosses a ball in an upward arc. This is useful in various practice situations where a tossed ball is desired. The prior art pitches the ball at a substantially horizontal line, such as how the ball would be thrown by a baseball pitcher. The underhand ball tossing machine 10 tosses a ball in a motion similar to an underhand motion and is ideal in situations such as fungo, tennis, ping-pong, and racquetball practice. Fungo practice is where a hitter hits balls into the outfield to provide practice to the fielders. Prior to the present invention, the hitter would toss a baseball or softball into the air, then hit it with a bat, requiring quick motion to toss the ball then get their hands on the bat for hitting. The underhand ball tossing machine 10 is ideal for certain tennis practice where the student is practicing hitting a ball that has an arc, such as a lob.

The underhand ball tossing machine 10 is enclosed in a cabinet 18 and has a ball supply bin 12 that is loaded with a supply of balls 14. In some embodiments, a push handle 16 is provided to assist in relocating the underhand ball tossing machine 10. Also, in some embodiments, an access door 17 is provided to enable access to the internal components of the underhand ball tossing machine 10. The toss action is provided by a tossing arm 40 that swings in an arc 34 carrying a ball 45. A ball stop 42 holds the ball in the tossing arm 40 until the tossing arm 40 abruptly stops when it reaches the stop peg 8, at which point the ball 45 is tossed. In some embodiments, leveling devices 30 are provided to individually adjust the height of each corner of the underhand ball tossing machine 10 along with roller wheels 32 to assist in relocating and positioning the underhand ball tossing machine 10.

Figure 2:
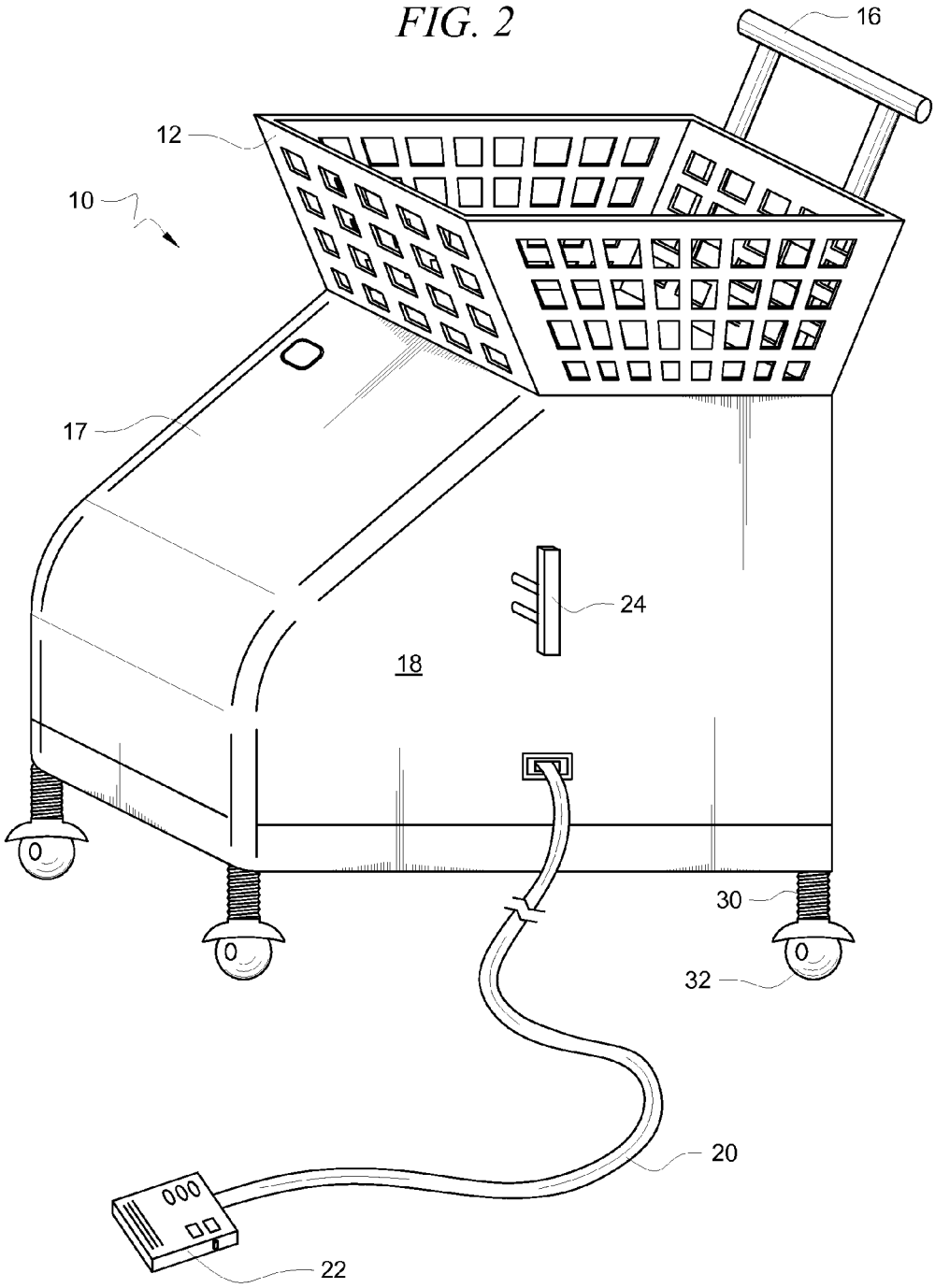
FIG. 2 illustrates a second side isometric view of an apparatus for underhand tossing of a ball of a first embodiment of the present invention.

Referring to FIG. 2, a second side isometric view of an apparatus for underhand tossing of a ball of a first embodiment of the present invention is shown. In addition to the features shown in FIG. 1, this view shows an optional remote control 22 that, in some embodiments, is connected to the underhand ball tossing machine 10 by a cable 20, although in other embodiments, the remote control 22 is wireless. In some embodiments, a remote control hook 24 is provided to hold the remote control 22 and cable 20 when not in use (see FIG. 3).

Figure 3:
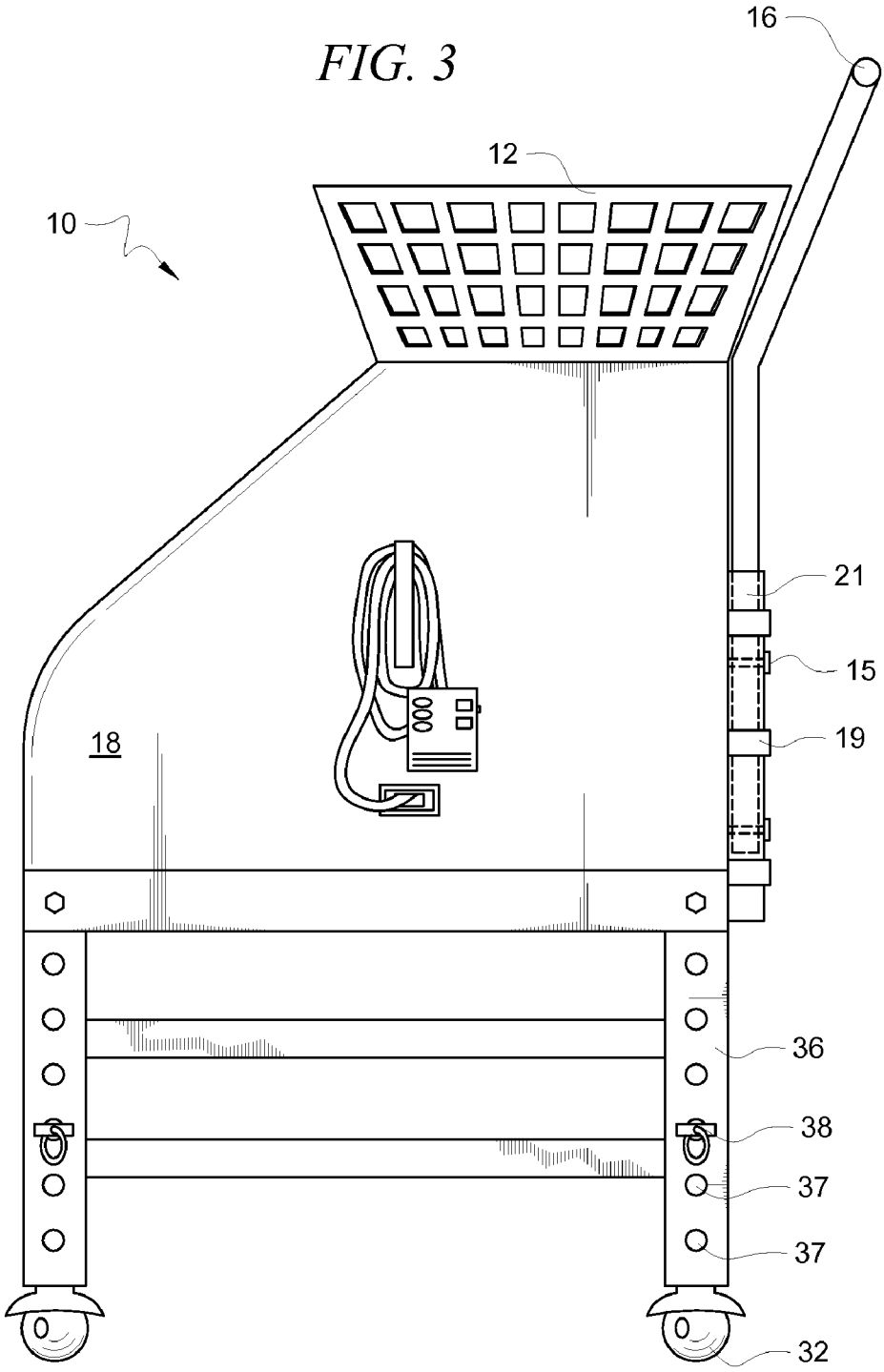
FIG. 3 illustrates a side view of an apparatus for underhand tossing of a ball of a first embodiment of the present invention.

Referring to FIG. 3, a side view of an apparatus for underhand tossing of a ball of a first embodiment of the present invention is shown. This view shows the optional handle 16 adjustment mechanism that includes a handle retainer tube 21, brackets 19 and retaining handle pins 15. In this embodiment, the height of each corner of the underhand ball tossing machine 10 is adjusted by adjustment legs 36 that include a plurality of adjustment holes 37 and leg adjustment pins 38 to hold the leg in the desired position.

Figure 4:
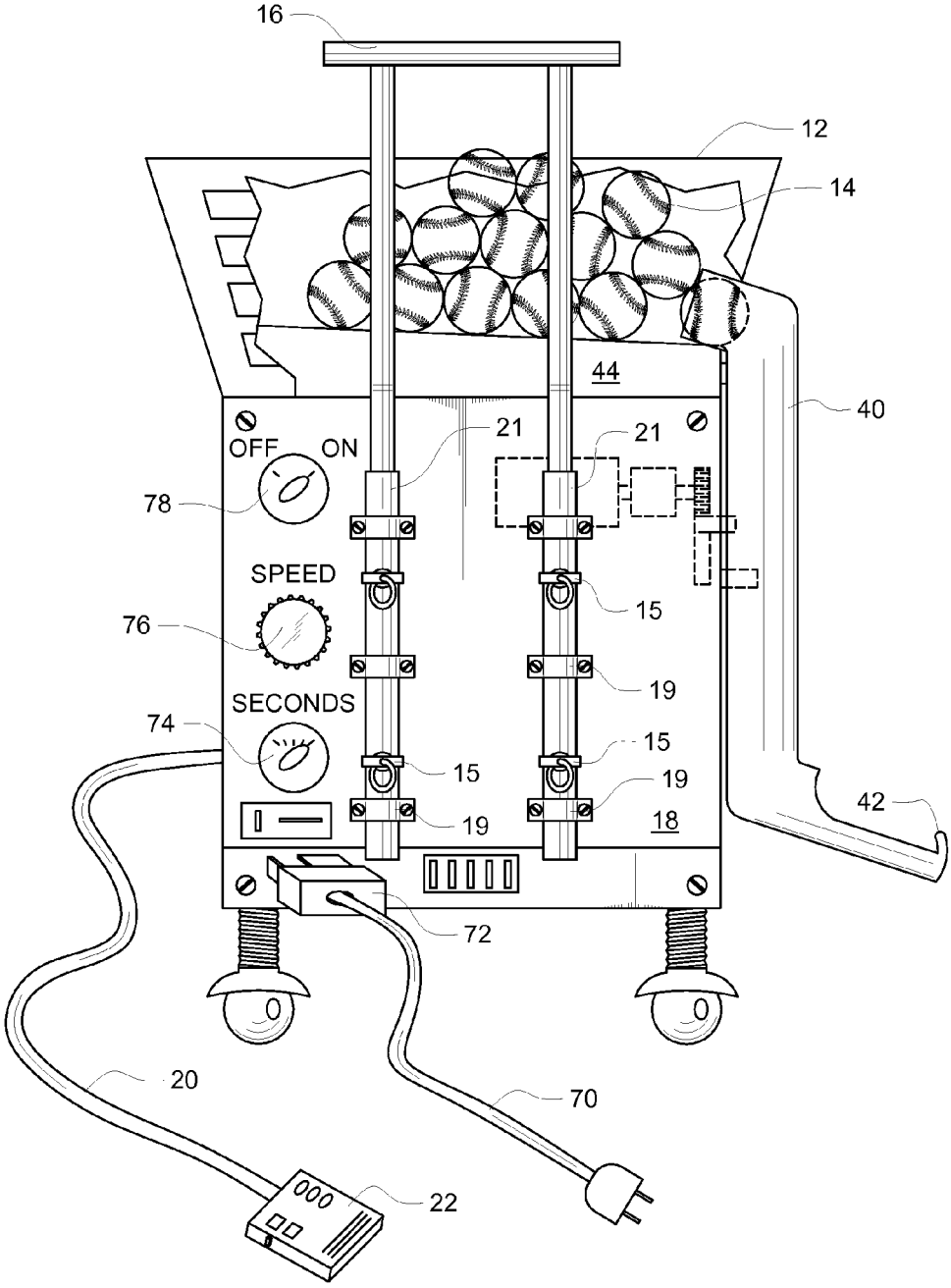
FIG. 4 illustrates a rear view of the first embodiment of apparatus for underhand tossing of a ball of the present invention.

Referring to FIG. 4, a rear view of the first embodiment of apparatus for underhand tossing of a ball of the present invention is shown. In some embodiments, all controls are located on the remote control 22. As shown in FIG. 4, in some embodiments controls for on/off 78, ball speed 76 and ball timing (seconds) 74 are located on the underhand ball tossing machine 10 cabinet 18. A removable power cord 70 with connector 72 is provided for connecting to AC power to provide power to run the underhand ball tossing machine 10 or to recharge internal batteries (not shown) as known in the art. The tossing arm 40 is hollow to allow balls 14 to enter at a first end and drop down to the ball stop 42 until they are tossed. In this view, it can be seen that the floor 40 of the ball bin 12 is slanted to urge the balls 14 toward the tossing arm 40.

Figure 5A:
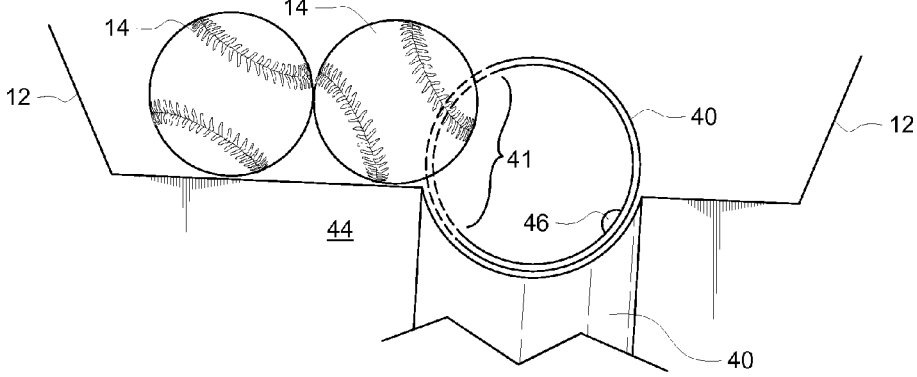
FIG. 5A-5C illustrates a sequence of movements of a tossing arm of the present invention.
Figure 5B:
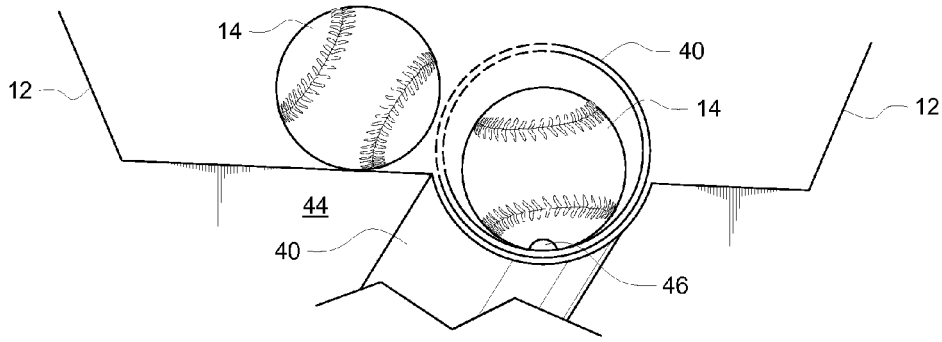
Figure 5C:
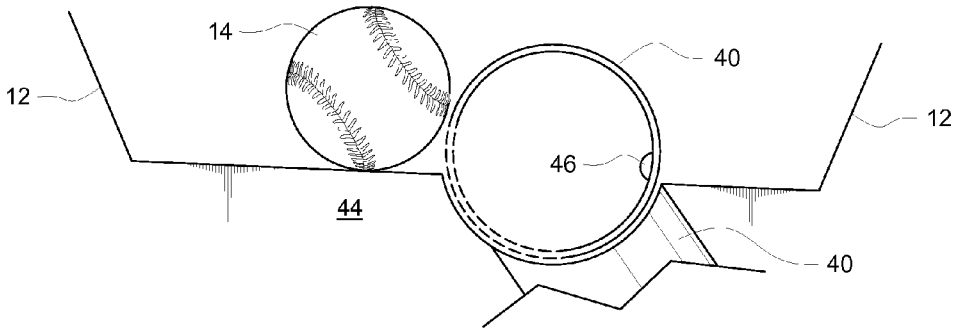

Referring to FIG. 5A-5C, a sequence of movements of a tossing arm of the present invention is shown. It is desired to toss exactly one ball with each swing of the tossing arm 40. To achieve this, a ball registration mechanism is used as that shown in FIG. 5A-5C, although other registration mechanisms are known and used in alternate embodiments. The ball registration mechanism includes an opening 41 in the portion of the tossing arm 40 that extends beneath the ball supply 14. When the tossing arm 40 is at rest (substantially vertical) as in FIG. 5A, the opening 41 is partially obstructed by the slanted floor 44 of the ball bin 12, preventing balls from entering the tossing arm 40. When the tossing arm 40 is cocked back as in FIG. 5B by the motor mechanism (shown in FIG. 6), the opening 41 is positioned to allow a ball 14 to drop into the hollow tossing arm 40, but is prevented from dropping down the tossing arm 40 by a protrusion 46. As the tossing arm 40 moves through the rest position and towards the tossing position as shown in FIG. 5C, the protrusion 46 rotates out of the way of the ball 14 and the ball 14 rolls down the tossing arm 40 to be thrown on the next cycle.

Figure 6:
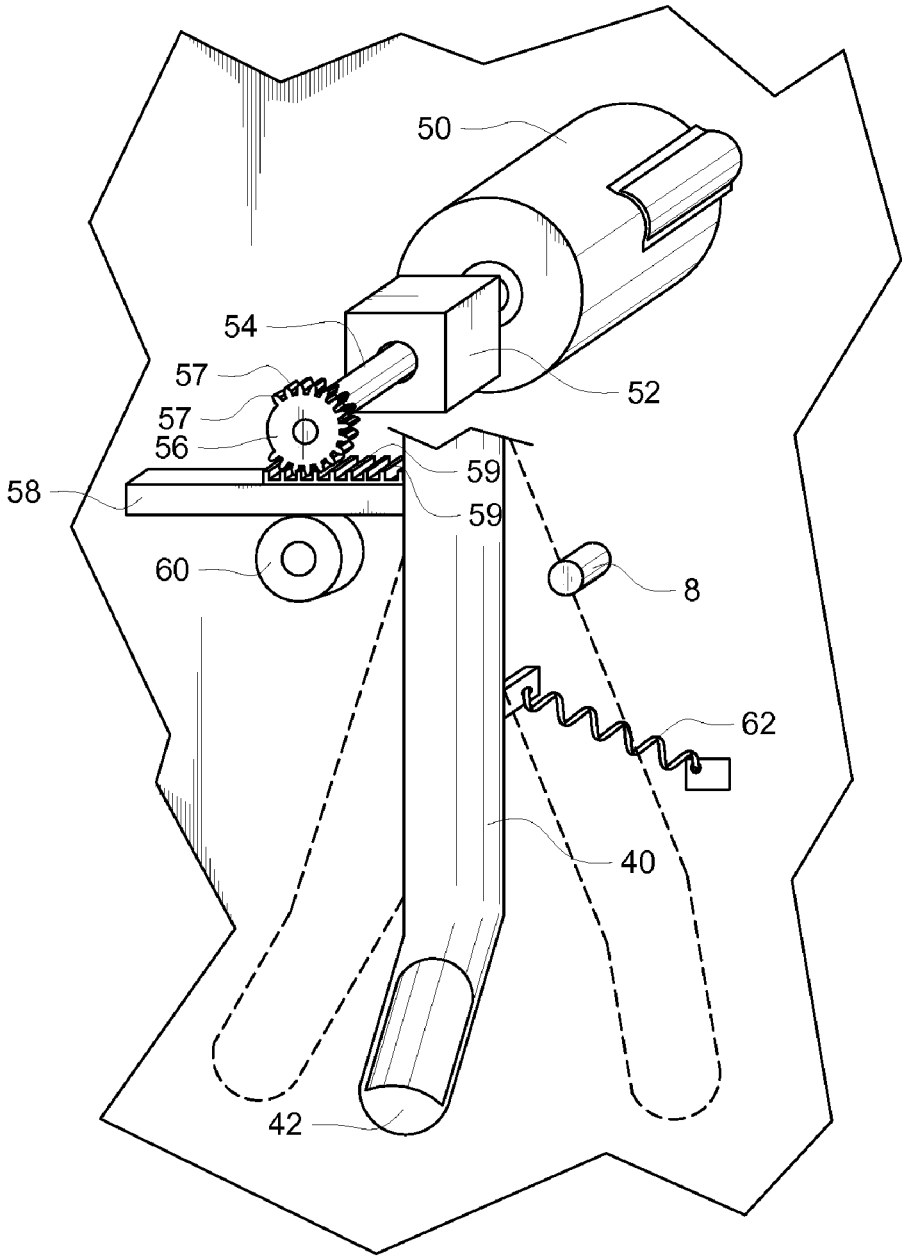
FIG. 6 illustrates a cutaway view of the apparatus for underhand tossing of a ball of the present invention showing the drive mechanism.

Referring to FIG. 6, a cutaway view of the apparatus for underhand tossing of a ball of the present invention showing the drive mechanism is shown. The mechanism shown in FIG. 6 is an exemplary mechanism as there are many such mechanisms that produce a similar movement, all of which are included in the present disclosure. In this exemplary mechanism, a motor 50 produces rotational force at a speed controlled by a controller (see FIG. 11). In some embodiments, the rotational speed is reduced by a gear box 52, turning a shaft 54 at a desired cycle speed. The shaft 54 turns a special gear 56 with teeth 57 that are present only on part of the circumference of the gear 56. The teeth 57 mate with teeth 59 of a gear rack 58 so that as the gear 56 turns in a clock-wise direction, the rack 58 is drawn towards the left (back end of the cabinet 18). A roller 60 is positioned under the gear 56, holding the rack 58 against the gear 56. As the gear 56 turns, the rack 58 is drawn away from the stop peg 8. The rack is coupled to the tossing arm 40, thereby pulling the tossing arm 40 away from the stop peg 8 and tensioning the spring 62 which is coupled to the tossing arm 40 at one end and to the cabinet 18 at a distal end. As the gear 56 continues to turn, it eventually reaches the location of the gear where there is a void of gear teeth. At this point, the tossing arm 40 is completely cocked and the spring 62 fully tensioned. When the void of gear teeth is reached, the rack 58 is free to slide toward the stop, thereby allowing the tossing arm 40 to be pulled by the spring 62 toward the stop peg 8 until it hits the stop peg 8, thereby tossing the ball that is positioned in the bottom of the tossing arm 40. It is preferred that the gear rack 58 be long enough such that as the tossing arm 40 reaches the stop peg 8, the gear rack 58 remains positioned between the gear 56 and the roller 60 to engage with the gear teeth 57 for the next cycle. It is preferred that the stop peg 8 be made of a stiff material such as rubber.

Figure 7:
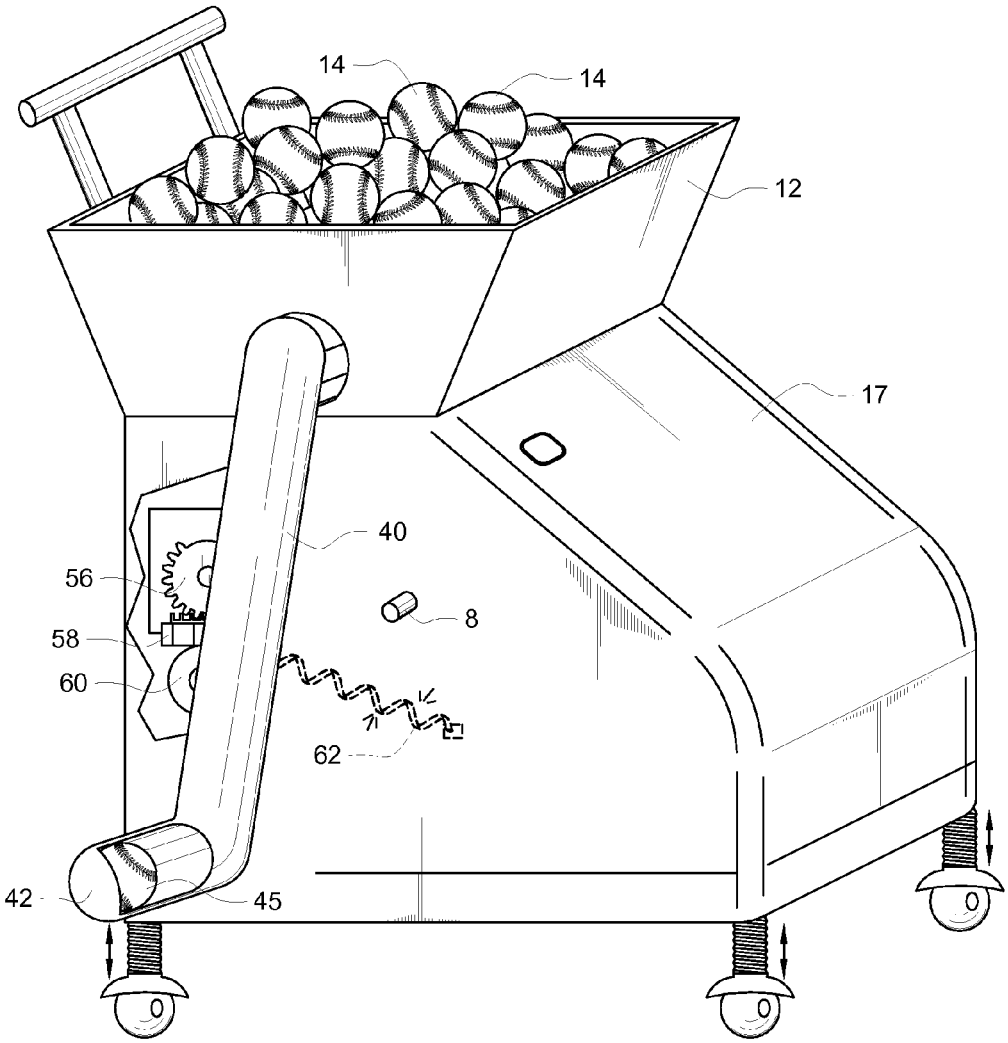
FIG. 7 illustrates a side view of the apparatus for underhand tossing of a ball of the present invention showing the tossing arm being cocked.

Referring to FIG. 7, a side view of the apparatus for underhand tossing of a ball of the present invention showing the tossing arm being cocked is shown. In this view, the tossing arm 40 is positioned partially towards the cocked position and the spring 62 is slightly stretched. A ball 45 is ready to be tossed.

Figure 8:
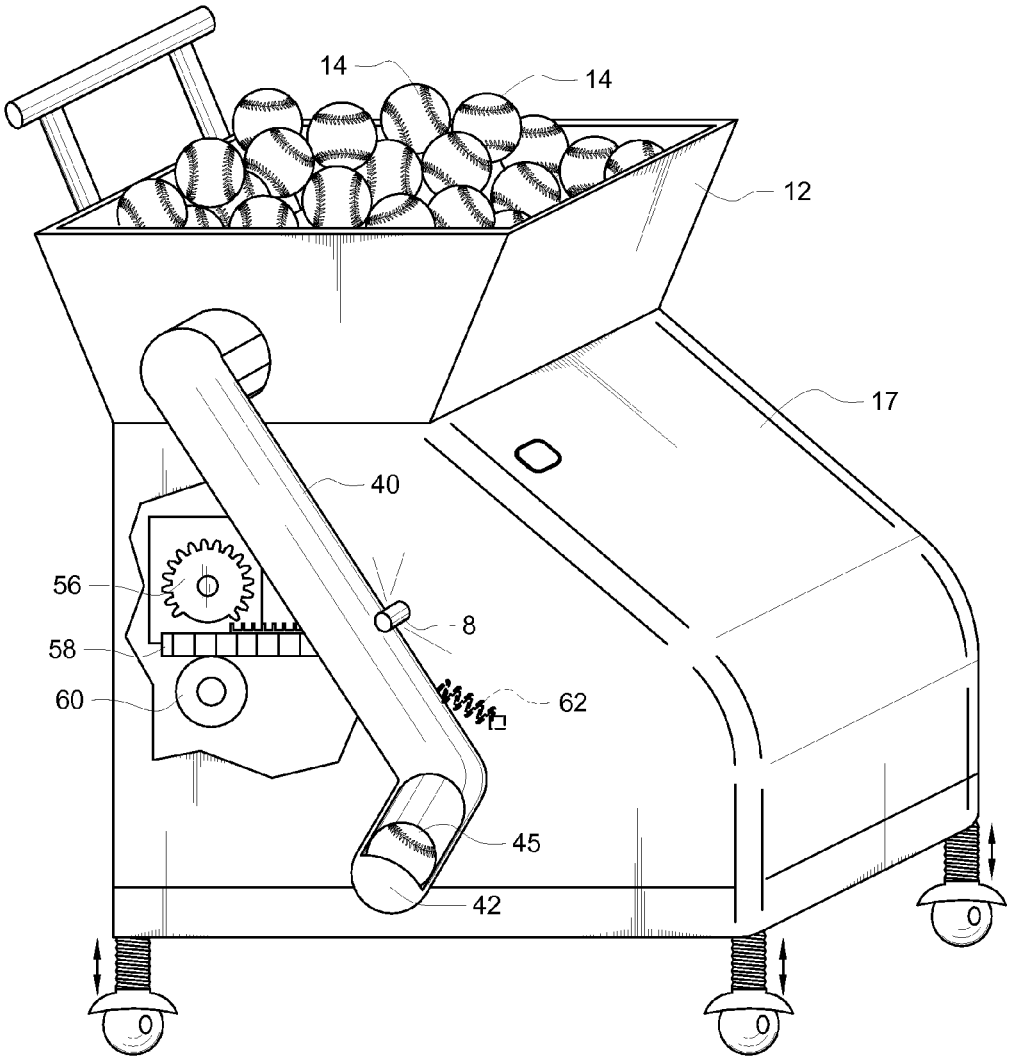
FIG. 8 illustrates a side view of the apparatus for underhand tossing of a ball of the present invention showing the tossing arm being released just before stopping against the stop.
Figure 9:
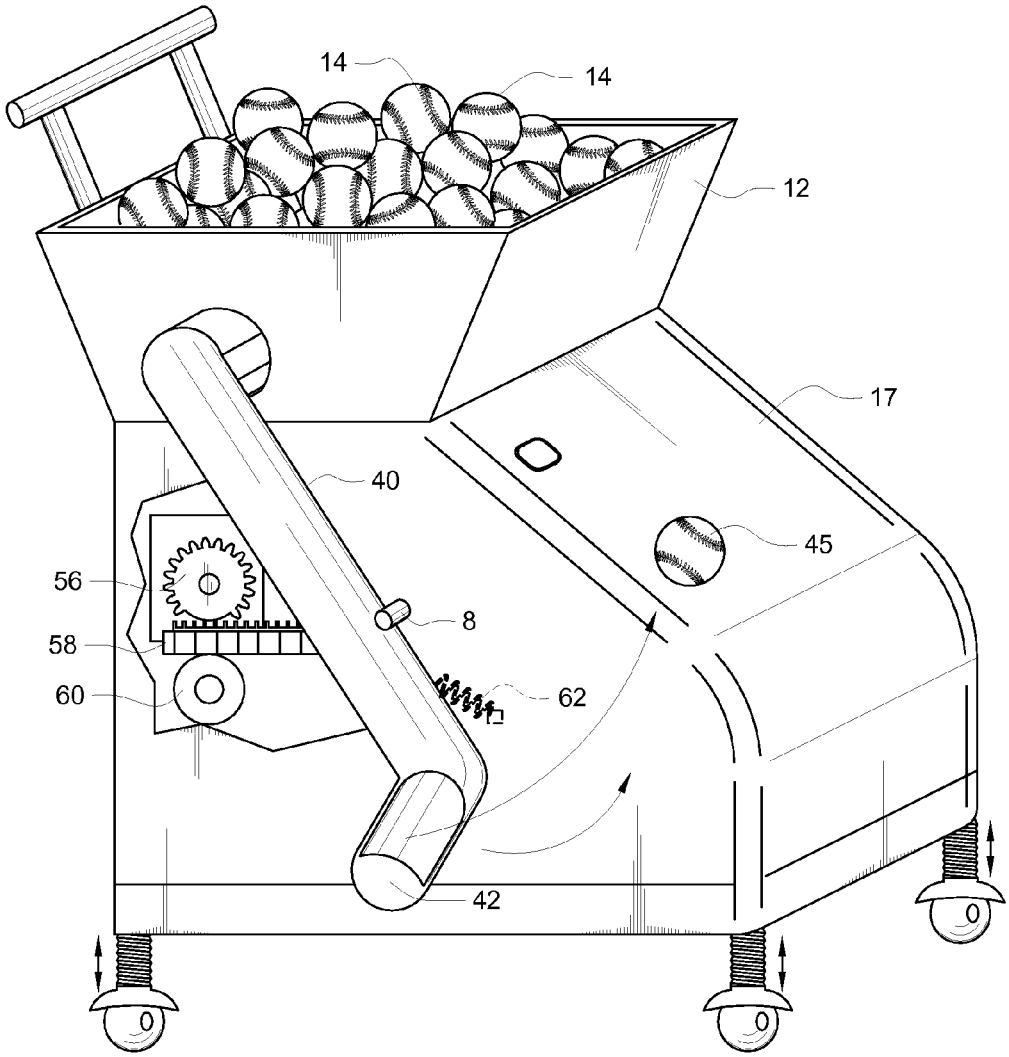
FIG. 9 illustrates a side view of the apparatus for underhand tossing of a ball of the present invention showing a ball being tossed after the tossing arm stops forward motion.

Referring to FIGS. 8 and 9, a side view of the apparatus for underhand tossing of a ball of the present invention showing the tossing arm 40 being released and just before stopping against the stop peg 8 (FIG. 8) and after the tossing arm 40 stops its forward motion (FIG. 9) is shown. In FIG. 8 view, the gear 56 has rotated far enough so that the portion of the gear 56 that is without teeth is over the rack 58 and has released the rack, allowing the spring 62 to pull the tossing arm 40 towards the stop peg 8. In FIG. 9, the tossing arm 40 has stopped after hitting the stop peg 8, but the ball 45 continues as an underhand throw.

Figure 10:
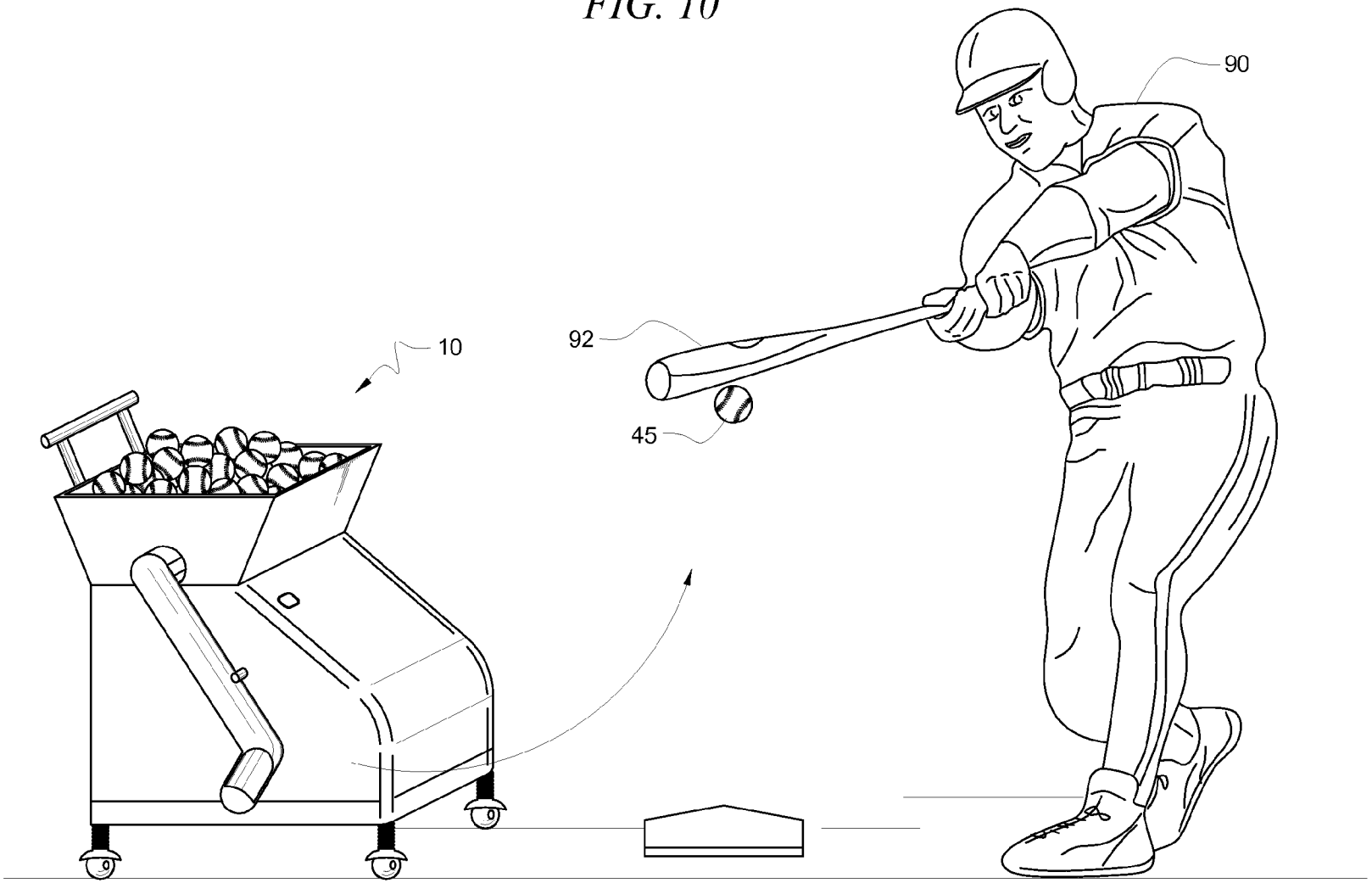
FIG. 10 illustrates the apparatus for underhand tossing of a ball of the present invention being used in baseball practice.

Referring to FIG. 10, the apparatus for underhand tossing of a ball of the present invention being used in baseball practice is shown. The underhand ball tossing machine 10 has just completed tossing the ball 45 as described above and a player 90 is hitting the ball 45 with a bat 92 to, for example, a fielder to practice catching.

Figure 11:
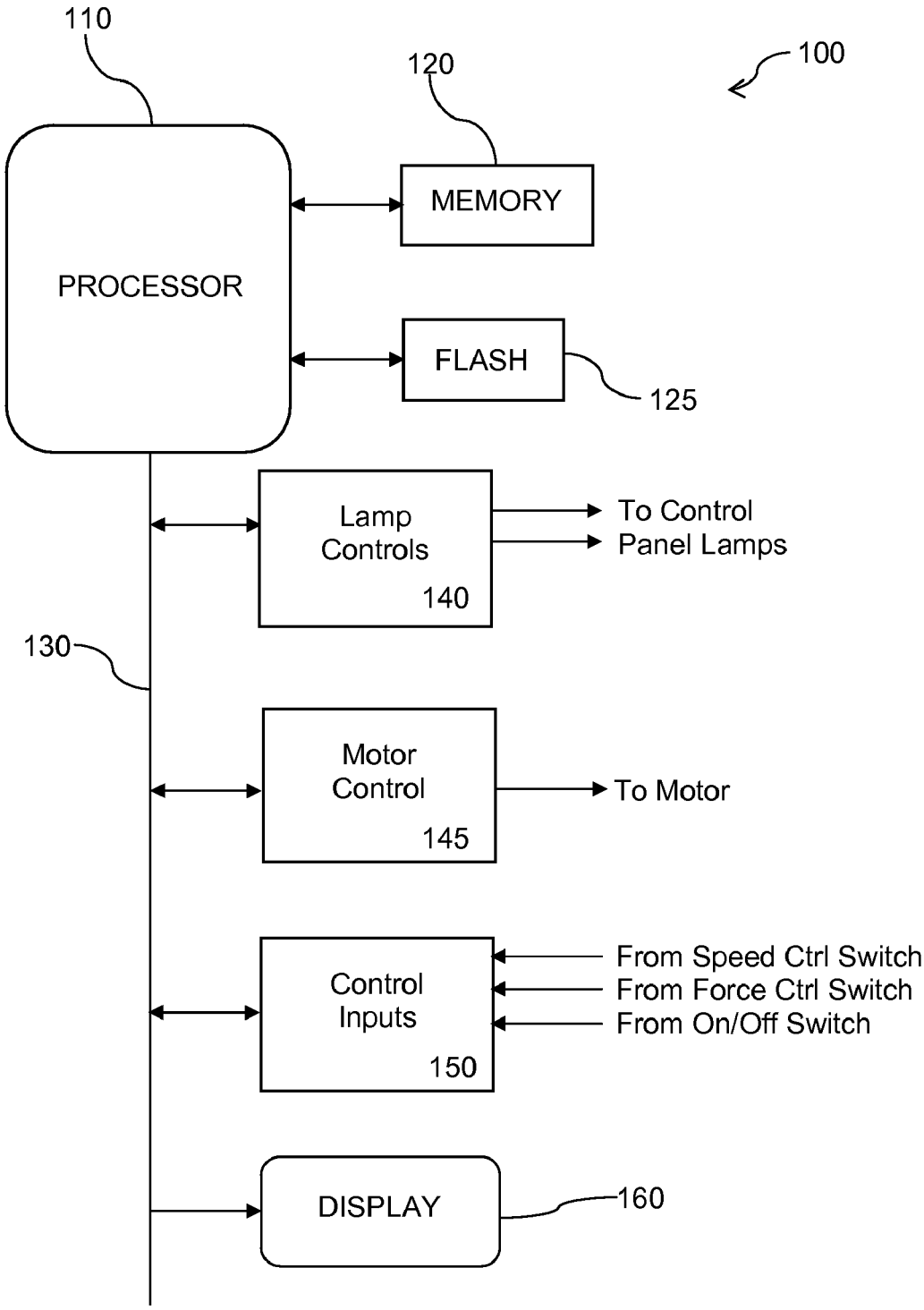
FIG. 11 illustrates a schematic view of the apparatus for underhand tossing of a ball of the present invention.

Referring now to FIG. 11, a schematic view of an exemplary controller of the present invention is shown. The controller 100 is a simplified example of a typical processor-based controller that is used to control systems such as the underhand ball tossing machine 10 disclosed here within. The controller 100 has a processor 110 and associated memory 120 and program storage 125, in this example, Flash memory. This is an exemplary system and any suitable processor, memory and persistent storage can be substituted including microcontrollers such as the Intel® 80C51, processors such as the Intel® Pentium IV, memory such as SDRAM and DDR and persistent storage such as ROM, EPROM, hard disks, etc. The operating program and data parameters are typically stored in the persistent storage 125 and are typically loaded into the memory 120 and executed by the processor 110. A system bus 130 interfaces the processor to peripheral devices as discussed below.

The processor displays information, alerts, prompts, etc., on a display 160. In some embodiments, the display 160 is a numeric or alpha-numeric display for indicating operating parameters of the underhand ball tossing machine 10 of the present invention. In other embodiments, the display is a set of lights or any combination of lights and displays. Control of the system is initiated by control inputs 150. In some embodiments, the control inputs 150 include a remote control device, either wired or wireless as known in the industry. In other embodiments, the control inputs 150 include push button switches, rotary switches, potentiometers and digital potentiometers, etc.

The controller 100 has various analog or digital outputs and inputs to control and monitor the operation of the underhand ball tossing machine 10 of the present invention. For example, there are lamp control outputs 140 to illuminate/extinguish status lamps, motor control outputs 145 to control the speed of the motor 50 inputs 150 from the control switches 74/76/78.

Equivalent elements can be substituted for the ones set forth above such that they perform in substantially the same manner in substantially the same way for achieving substantially the same result.

It is believed that the system and method of the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

What is claimed is:

1. A device for underhand tossing of a ball, the device comprising:

a cabinet;

a hollow tossing arm pivotally coupled at a first end to the cabinet;

a means to dispense a single ball at a time from a supply of balls into the hollow tossing arm;

a spring affixed at one end to the hollow tossing arm and affixed at a distal end to the cabinet at a point forward of the hollow tossing arm;

a means for pulling a distal end of the hollow tossing arm toward a back end of the cabinet and for releasing the hollow tossing arm such that the distal end of the hollow tossing arm swings forward, releasing the ball at a point at which the hollow tossing arm hits a stop peg; and a controller, the controller adapted to accept control inputs and the controller adapted to control the speed of the means for pulling wherein the means to dispense the single ball includes an opening in the first end of the hollow tossing arm, the opening large enough to allow the passage of the single ball, the opening unobstructed only when the hollow tossing arm is pulled back by the means for pulling the hollow tossing arm.

2. The device for underhand tossing of a ball of claim 1, wherein the means for pulling the hollow tossing arm toward the back end includes a gear rack operably engaged with the hollow tossing arm and a gear operably engaged with the gear rack, the gear having a gear teeth, a portion of a circumference of the gear void of gear teeth, the gear operably coupled to a motor.

3. The device for underhand tossing of a ball of claim 1, wherein the ball is selected from the group consisting of a baseball, a softball, a soccer ball, a racquet ball and a tennis ball.

4. The device for underhand tossing of a ball of claim 1, further comprising a protrusion within the end portion the hollow tossing arm, the protrusion blocking the single ball from passing through the hollow tossing arm only when the hollow tossing arm is pulled back by the means for pulling the hollow tossing arm.

5. A method of practicing ball comprising:

providing a device for underhand tossing of a ball, the device comprising:

a cabinet;

a hollow tossing arm pivotally coupled at a first end to the cabinet;

a means to dispense a single ball at a time from a supply of balls into the hollow tossing arm;

a spring affixed at one end to the hollow tossing arm and affixed at a distal end to the cabinet at a point forward of the hollow tossing arm; and a means for pulling a distal end of the hollow tossing arm toward a back end of the cabinet and for releasing the hollow tossing arm such that the distal end of the hollow tossing arm swings forward, releasing the ball at a point at which the hollow tossing arm hits a stop peg;

a controller, the controller adapted to accept control inputs and the controller adapted to control the speed of the means for pulling the hollow tossing arm toward the back end;

wherein the means to dispense the single ball at a time includes an opening in the first end of the hollow tossing arm, the opening large enough to allow the passage of the single ball, the opening unobstructed only when the hollow tossing arm is pulled back by the means for pulling the hollow tossing arm;

setting the device for underhand tossing of a ball to automatically toss balls in the air;

allowing the ball to arc; and on a downward travel of the ball, hitting the ball with a hitting object.

6. The method of claim 5, wherein the hitting object is selected from the group consisting of a bat, a club and a racquet.

7. The method of claim 5, wherein the means for pulling the hollow tossing arm toward the back end includes a gear rack operably engaged with the hollow tossing arm and a gear operably engaged with the gear rack, a circumference of the gear having gear teeth, a portion of the circumference of the gear void of gear teeth, the gear operatively coupled to a motor.

8. The method of claim 5, wherein the ball is selected from the group consisting of a baseball, a softball, a soccer ball, a racquet ball and a tennis ball.

9. The method of claim 5, further comprising a protrusion within the end portion the hollow tossing arm, the protrusion blocking the single ball from passing through the hollow tossing arm only when the tossing arm is pulled back by the means for pulling the hollow tossing arm.

10. A tossing machine comprising:

a cabinet;

a hollow tossing arm pivotally coupled at a first end to the cabinet and the hollow tossing arm having an opening near the first end large enough for a ball to pass into the hollow tossing arm, the opening at least partially obstructed when a distal end of the hollow tossing arm is in a first range of travel;

a spring affixed at one end to the hollow tossing arm and affixed at a distal end to the cabinet at a point forward of the hollow tossing arm;

a motor;

a gear having gear teeth on only a portion of a circumference and missing teeth on the remainder of the circumference, the gear operatively coupled to the motor; and a rack having rack gear teeth for mating with the gear teeth, the rack coupled to the hollow tossing arm and the rack engaged with the gear so that rotation of the gear pulls the tossing arm toward a back end of the cabinet until the missing teeth interface with the rack thereby releasing the rack allowing the distal end of the hollow tossing arm to swing forward pulled by the spring, the ball is tossed when the hollow tossing arm hits a stop peg.

11. The device for underhand tossing of a ball of claim 10, further comprising a controller, the controller adapted to accept control inputs and the controller adapted to control the speed of the motor.

12. The device for underhand tossing of a ball of claim 10, wherein the ball is selected from the group consisting of a baseball, a softball, a soccer ball, a racquet ball and a tennis ball.

13. The device for underhand tossing of a ball of claim 10, further comprising a protrusion within the end portion the hollow tossing arm, the protrusion blocking the ball from passing through the tossing arm only when the tossing arm is pulled back by the rack.

14. The device for underhand tossing of a ball of claim 10, wherein the stop peg is made of stiff rubber.

* * * * *